United States Patent [19]

Sackl

[11] Patent Number: 4,596,386

[45] Date of Patent: Jun. 24, 1986

[54] EXERCISE DEVICE

[76] Inventor: Herbert Sackl, 3 Warringal Avenue, Bulleen 3105 Victoria, Australia

[21] Appl. No.: 521,929

[22] Filed: Aug. 10, 1983

[30] Foreign Application Priority Data

Aug. 10, 1982 [AU] Australia ..... PF5301
Jan. 25, 1983 [AU] Australia ..... PF7760

[51] Int. Cl.[4] ..... A63B 69/16
[52] U.S. Cl. ..... 272/73; 272/DIG. 4
[58] Field of Search ..... 272/73, 132, DIG. 4

[56] References Cited

U.S. PATENT DOCUMENTS 4,262,899 4/1981 Alvarez ..... 272/73

FOREIGN PATENT DOCUMENTS 2900483 7/1980 Fed. Rep. of Germany ..... 272/73

*Primary Examiner*—Richard J. Apley
*Assistant Examiner*—Kathleen J. D'Arrigo
*Attorney, Agent, or Firm*—Steele, Gould & Fried

[57] ABSTRACT

An exercise device has a base, a support for the axle of a manually drivable wheel of a cycle, a roller bearing against the wheel, and movable holding bodies for mounting the roller with respect to the support. The bodies are located in holders in selected rotated position about a center and hold the bodies against rotation. Axle means extend between the bodies and carry the roller, the axle means being eccentric with respect to the center of the bodies. The bodies are selectively located by placing them in the holders at selected rotated positions, which position the roller at selected distances from the support. In this manner the frictional resistance against turning imparted to the wheel and the roller may be selectively varied.

8 Claims, 8 Drawing Figures

EXERCISE DEVICE

BACKGROUND OF THE INVENTION

1. Field of the Invention

This invention relates to the field of exercise devices and in particular to an exercise cycle device.

2. Description of the Prior Art

U.S. Pat. No. 4,262,899—Alvarez discloses an accessory for exercising on a bicycle. The rear end of the bicycle is held in an elevated position and engages a friction wheel rather than the ground.

West German Offenlegungsshcrift No. 29 00 483 dated July 17, 1980 discloses a stand and roller device for exercising on a bicycle. The spacing of two rollers can be varied to accommodate bicycle wheels of different diameters.

SUMMARY OF THE INVENTION

It is an object of the invention to provide a device which can be used with a conventional bicycle to enable the bicycle be used for exercise. However, this invention is not confined to the use of conventional bicycles and may also be applied to cycles especially constructed for the purpose of exercising. In this last respect, the cycle may be provided with only one wheel.

The exercise device of the invention has a base, a support for the axle of a manually-drivable wheel of a cycle, a roller to bear against the wheel, and bodies for mounting the roller with respect to the support. Holding means locate the roller-mounting at selected rotated positions about a center of the bodies and fix the bodies against rotation. A roller axle means extends between the bodies and carries the roller, the roller axle being eccentric with respect to the center of the roller-mounting bodies. As a result of the eccentricity, locating the bodies in the holding means at selected rotated orientations is effective to the wheel position the roller at selected distances from the wheel support, whereby frictional resistance against turning imparted to the wheel by the roller may be selectably varied.

The roller-mounting bodies are preferably radially symmetrical. Preferably the roller-mounting bodies are prisms and the holding means include recesses in which the prisms can be non-rotatably placed at any selected one of the rotated positions. Preferably the bodies have apertures eccentric to their centers for receiving an axle means carrying a roller.

A number of such holdings means for the roller mounting body are preferably provided whereby the roller may be positioed to suit cycles having different sized wheels. Similarly, a number of the wheel-mounting supports is provided whereby cycles having different sized wheels may be positioned to engage with the said roller.

In one alternative embodiment of the invention the base has projections and the roller-mounting bodies have apertures in them. By locating the appropriate apertures with respect to the projections, the bodies can be located in the selected rotated positions.

In another alternative embodiment of the invention the base has the apertures and the roller-mounting bodies have the projections. By locating the appropriate projections with respect to the apertures, the bodies can be located in the selected rotated positions.

The roller axle means may be integrally formed with one or another of the roller and the bodies. The roller axle may also be a separate integral item.

It may be necessary or desirable to further provide extension members for the wheel axle of the cycle so as to extend the wheel axle to reach into the supports. This also provides adequate space for cycle gears without interference with the supports.

BRIEF DESCRIPTION OF THE DRAWINGS

A specific embodiment of an exercise device in accordance with the invention is described hereinafter with the aid of the accompanying drawings in which.

DETAILED DESCRIPTION OF THE PREFERRED EMBODIMENTS

Figure 1:
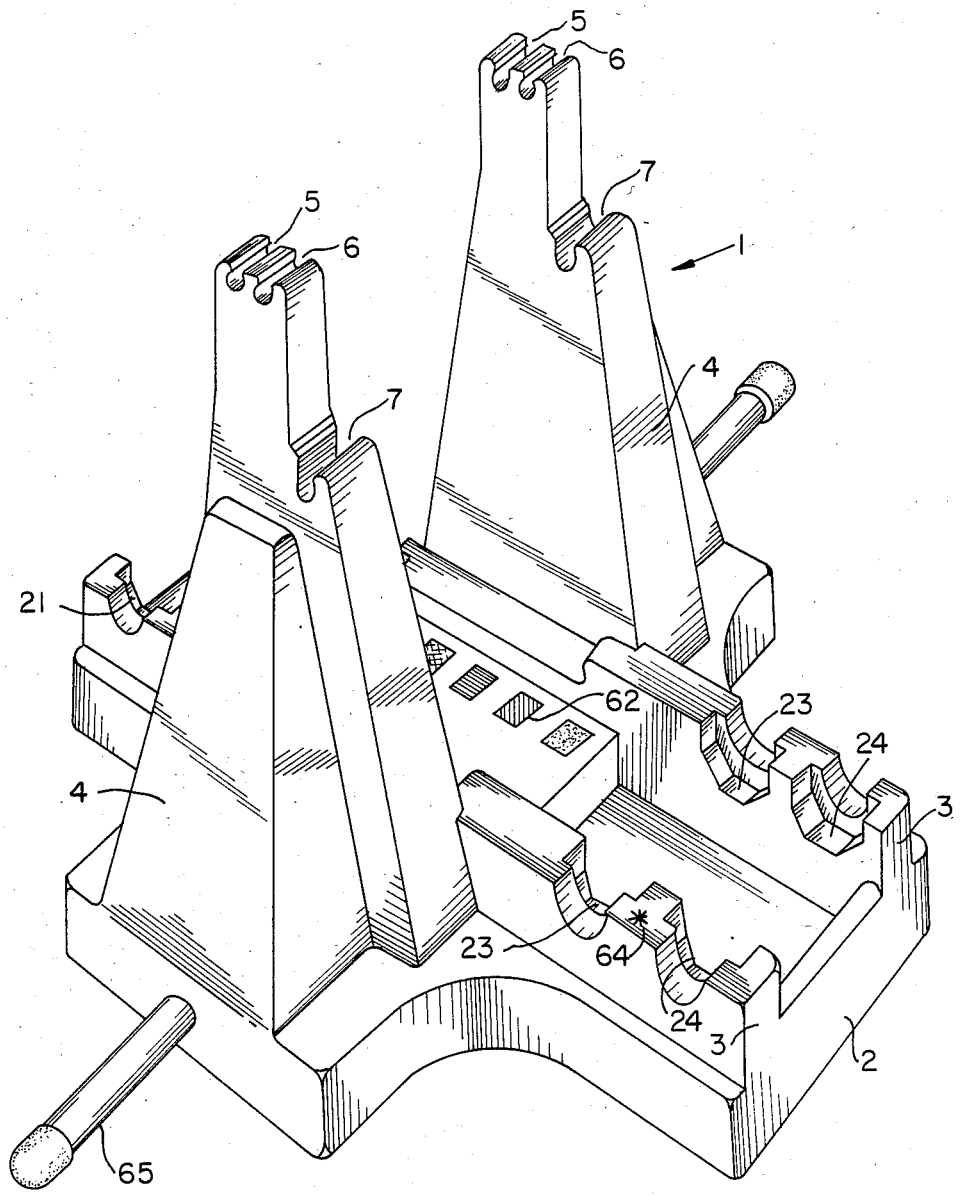
FIG. 1 is a perspective view of part of the device.
Figure 3:
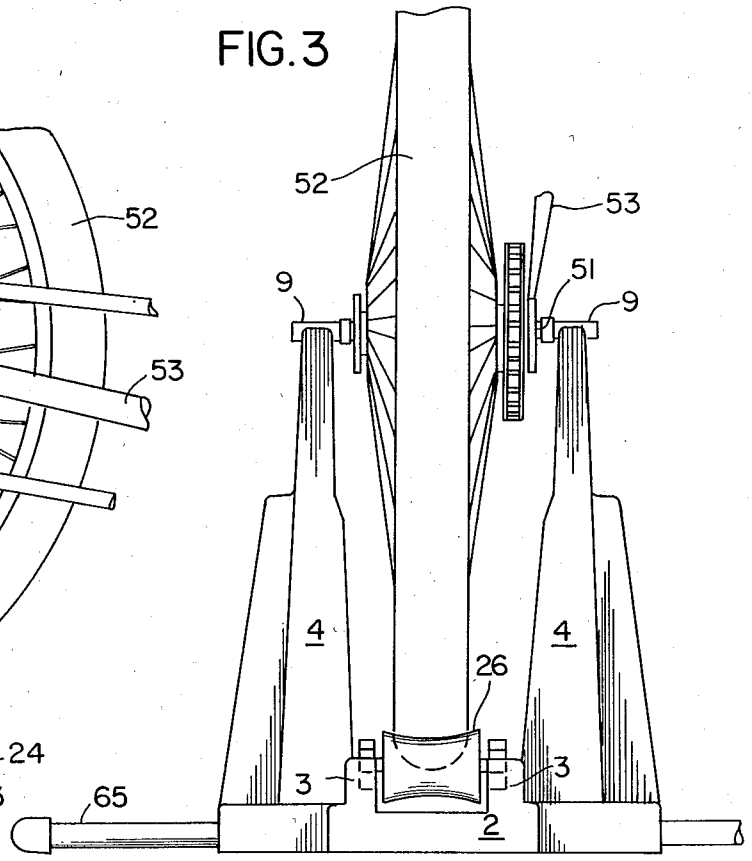
FIG. 3 is a rear elevation of the device showing it in use.
Figure 2:
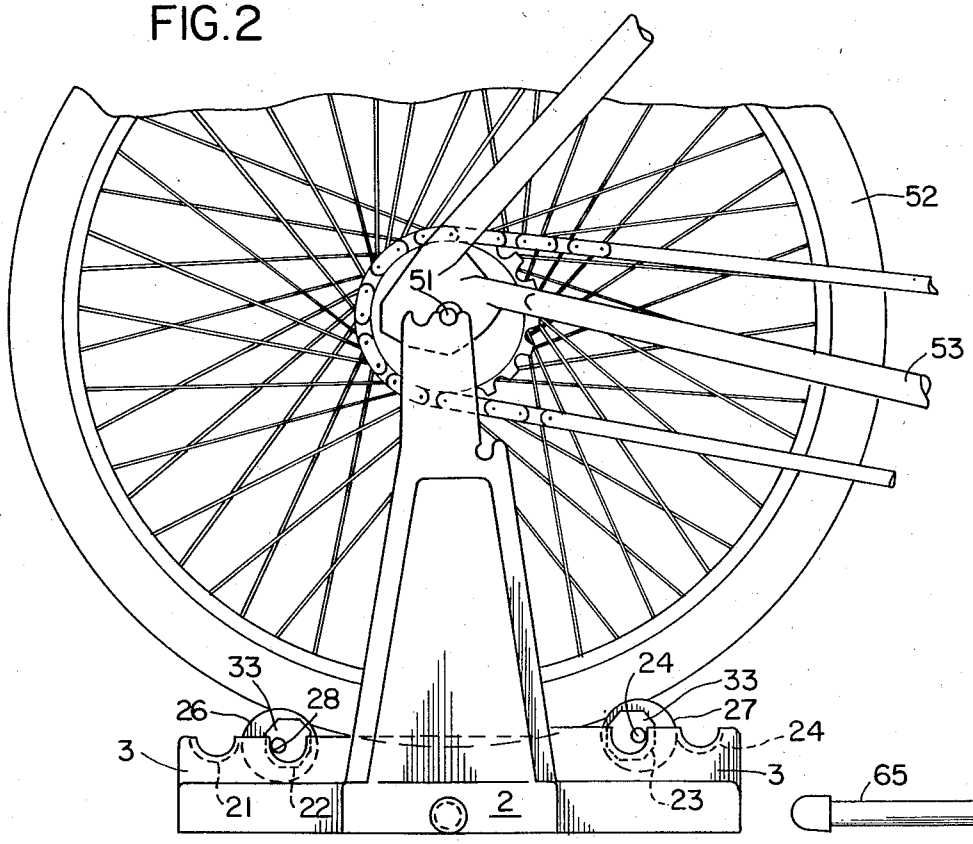
FIG. 2 is a side elevation view of the device showing it in use with a cycle wheel.
Figure 4:
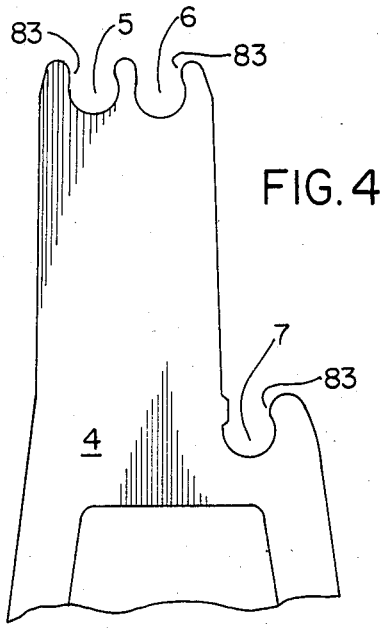
FIG. 4 is a side elevation view of the device.

The exercise device shown in the drawings includes a wheel supporting unit generally designated 1, for example made of synthetic plastic material. The wheel support unit 1 includes a base 2, side flanges 3 and towers 4. The towers 4 of wheel supporting unit 1 have notches 5, 6 and 7 in their upper ends into which an axle 51 of a driven wheel 52 of a cycle 53 can be located such that the wheel is supported.

Figure 5:
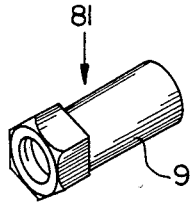
FIG. 5 is a perspective view of one form of wheel axle extender.
Figure 6:
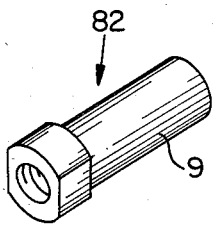
FIG. 6 is a perspective view of another form of wheel axle extender.
Figure 7:
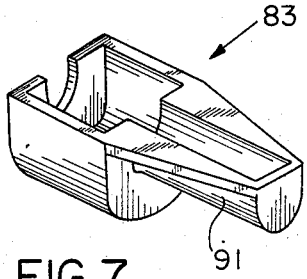
FIG. 7 is a perspective view of yet another form of wheel axle extender; and, FIG. 8 is a perspective view of another part of the device.
Figure 8:
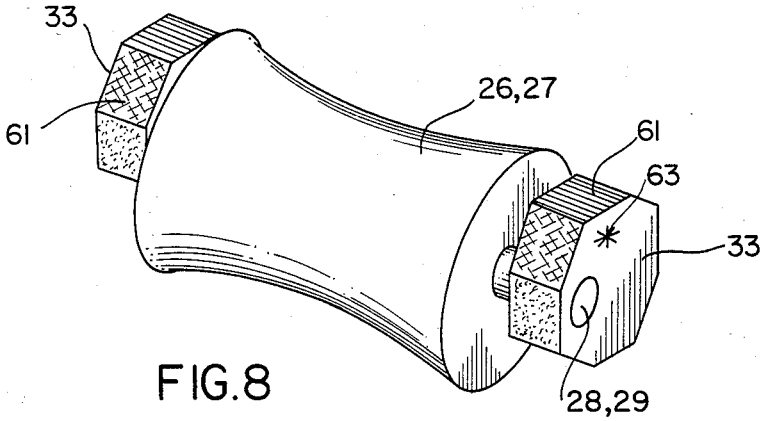

In the event that an axle of a particular cycle is too short to span between the towers 4 of wheel support unit 1, then extenders for the axle 51 may be used. Suitable forms of axle extenders are shown in FIGS. 5 to 7. In the case of FIGS. 5 and 6, the extenders 81 and 82 are internally threaded to screw onto the axle 51. Cylindrical portions 9 extend beyond the axle 51 so as to span between the towers 4 of wheel support 1, where portions 9 fit into and locate the axle with respect to the relevant ones of notches 5, 6, and 7. In the case of FIG. 7, the extender 83 is intended for use with cycles having quick release wheel holding mechanisms on their axles and has a semi-cylindrical part 91 to be placed in the relevent ones of notches 5, 6, and 7.

The use of the extenders is preferred as they help in reducing damage to the towers 4 of wheel support 1. The extenders allow a substantial range of cycle sizes to be accommodated because, within reason, the extenders may be made to any length.

The notches 5, 6 and 7 in towers 4 of support 1, are narrowed at their upper ends at 83. The notches therefore tend to capture the cylindrical portions 9 of the extenders 81 and 82.

The side flanges 3 each have semi-octagonal recesses 21, 22, 23 and 24 in them for receiving bodies 33. The device further includes roller 26 and 27, having axles 28 and 29. The axles 28 and 29 are supported in holes 31 in bodies 33, which are octagonal in cross section. It is particularly to be noted that the axle holes in bodies 33 are eccentric with respect to the centers of the octagonal bodies.

In use, the axle of a 20 inch cycle is located in notches 7, that of a 27 inch cycle in notches 6 and that of a 28 inch cycle in notches 5. The octagonal cylinders 33 and an associated roller are located in recesses 22 and 24 in the case of a 20 inch cycle, in recesses 22 and 23 in the case of a 27 inch cycle and in recesses 21 and 23 in the case of a 28 inch cycle.

The wheel of the cycle bears on the rollers 26 and 27, which offer frictional resistance to turning. That frictional resistance can be varied by rotating the octagonal cylinders 33 in the appropriate one of the recesses 21–24 to effectively raise the height of the roller axles 28 and 29.

To enable easy reproduction of a desired frictional resistance from one use to another it is convenient that the flats of the octagonal cylinders 33 bear color coding, for example at 61, or some other marking. Thus, by always locating the same color or like marking, reproducible results are obtained. Further, as an aid to memory the color coding or marking may be reproduced on the base, for example, together with associated words such as "easiest", "easier", "moderate", "difficult", and "most difficult".

With such color coding or marking the two cylinders 33 for each roller will be mirror-image pairs and for purposes of ensuring correct orientation it is desirable that one cylinder of each pair bears a marking, such as at 63, which can be brought adjacent similar markings at 64 on the base.

To deal with gears on cycles, one of the towers 4 of support 1 may be more offset from a center line passing through the rollers 26 and 27 and/or may be recessed near is upper end. A stabilizer bar 65 may also be provided.

The support unit is conveniently made by injection moulding techniques and may be internally hollow. Modifications and adaptation may be made to the above described without departing from the spirit and scope of this invention which includes every novel feature and combination of features disclosed herein. For further particulars and to assess the scope of the invention, reference should be made to the claims.

I claim:

1. An exercise device comprising:

a base;

a support on the base having means for receiving an axle of a wheel of a cycle, the wheel being drivable by manual exertion ;

a roller and polygonal prisms , the prisms having a center and the prisms being adapted for mounting the roller with respect to the support, the base having recesses in which said prisms can non-rotatably nest in selected rotated positions about the center and for holding said prisms against rotation, axle means connecting said prisms and carrying the roller, said axle means defining an eccentric roller axis with respect to said center of the prisms, whereby locating said prisms by said recesses in selected rotated positions will position said roller at selected distances from said support, and whereby frictional resistance against turning imparted to the wheel by said roller may be selectably varied.

2. The exercise device of claim 1, wherein said prisms have apertures for receiving said axle means.

3. The exercise device of claim 1, wherein a number of the recesses are provided whereby said roller may be positioned to suit cycles having different-sized wheels.

4. The exercise device of claim 1, wherein the support has a number of means for receiving the axle of a wheel, whereby cycles having different sized wheels may be positioned to engage with said roller.

5. The exercise device of claim 1, wherein extension members are provided for the axle of the cycle.

6. The exercise device of claim 1, wherein said support includes means for releasably capturing said axle of the wheel of the cycle.

7. The exercise device of claim 5, wherein said support includes means for releasably capturing the extension members of the axle of the cycle.

8. The exercise device of claim 5, further comprising a second roller, and additional prisms and recesses for positioning said second roller, whereby the wheel of the cycle engages both the first roller and the second roller.

* * * * *